US010769925B2

(12) United States Patent
Perner

(10) Patent No.: US 10,769,925 B2
(45) Date of Patent: Sep. 8, 2020

(54) ELECTRONIC FALL EVENT COMMUNICATION SYSTEM

(71) Applicant: 3M INNOVATIVE PROPERTIES COMPANY, St. Paul, MN (US)

(72) Inventor: Judd J. Perner, East Dubuque, IL (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 16/066,372

(22) PCT Filed: Jul. 12, 2016

(86) PCT No.: PCT/US2016/041830

§ 371 (c)(1),
(2) Date: Jun. 27, 2018

(87) PCT Pub. No.: WO2017/116501

PCT Pub. Date: Jul. 6, 2017

(65) Prior Publication Data

US 2019/0012894 A1 Jan. 10, 2019

Related U.S. Application Data

(60) Provisional application No. 62/273,049, filed on Dec. 30, 2015.

(51) Int. Cl.

| | |
|---|---|
| ***G08B 23/00*** | (2006.01) |
| ***G08B 21/04*** | (2006.01) |
| ***G08B 25/08*** | (2006.01) |

(52) U.S. Cl.

CPC ..... *G08B 21/043* (2013.01); *G08B 21/0446* (2013.01); *G08B 25/08* (2013.01)

(58) Field of Classification Search

CPC ... G08B 21/043; G08B 21/0446; G08B 25/08

(Continued)

(56) References Cited

U.S. PATENT DOCUMENTS 4,593,273 A * 6/1986 Narcisse ..... G08B 21/0227 128/903
6,160,478 A * 12/2000 Jacobsen ..... G16H 50/20 340/539.12

(Continued)

FOREIGN PATENT DOCUMENTS

CN 104408876 3/2015
CN 104821062 8/2015

(Continued)

OTHER PUBLICATIONS

International Search Report for PCT International Application No. PCT/US2016/041830, dated Sep. 30, 2016, 4 pages.

*Primary Examiner* — Kerri L McNally
*Assistant Examiner* — Thang D Tran
(74) *Attorney, Agent, or Firm* — Kenneth B. Wood

(57) ABSTRACT

The fall event detection and communication system includes at least one fall detect node and a personal communication application. The at least one fall detect node is to be implemented as part of a fall protection system. The at least one fall detect node includes at least one detection element and a node transmitter. The at least one detection element is to generate an activation signal upon a condition that indicates a fall event has occurred. The node transmitter is to transmit at least one fall detect signal upon receiving the activation signal from the at least one detection element. The personal communication application is stored in a personal communication device. The personal communication application is to cause the personal communication device to monitor for the fall detect signal and cause the personal communication device to communicate with a remote communication device upon determination that a fall event has occurred.

17 Claims, 3 Drawing Sheets

(58) Field of Classification Search
USPC ..... 340/573.1
See application file for complete search history.

(56) References Cited

U.S. PATENT DOCUMENTS 7,059,182 B1 * 6/2006 Ragner ..... H05K 5/0086 73/200
8,610,585 B1 * 12/2013 Kielbasa ..... G08B 21/06 180/271
8,902,074 B2 * 12/2014 Landry ..... G08B 25/016 182/3
9,269,252 B2 * 2/2016 Mroszczak ..... G08B 21/0446
2001/0049241 A1 * 12/2001 McClure ..... B63C 9/0005 441/88
2006/0001545 A1 * 1/2006 Wolf ..... G08B 21/0461 340/573.1
2006/0214806 A1 * 9/2006 Clifford ..... A61B 5/1117 340/573.1
2007/0152837 A1 * 7/2007 Bischoff ..... G06F 19/3418 340/573.1
2008/0129518 A1 * 6/2008 Carlton-Foss ..... A61B 5/1117 340/573.1
2010/0142439 A1 * 6/2010 Hung ..... G01S 5/0205 370/328
2010/0185105 A1 * 7/2010 Baldinger ..... A61B 5/02416 600/500
2010/0231402 A1 9/2010 Flynt et al.
2010/0268304 A1 * 10/2010 Matos ..... G16H 40/63 607/60
2011/0025493 A1 * 2/2011 Papadopoulos .... A61B 5/02427 340/539.12
2011/0043630 A1 * 2/2011 McClure ..... A61B 5/1116 348/143
2012/0062377 A1 * 3/2012 Mock ..... G08B 21/088 340/539.11
2012/0101770 A1 * 4/2012 Grabiner ..... A61B 5/1116 702/141
2012/0223833 A1 * 9/2012 Thomas ..... G08B 21/0446 340/539.12
2012/0259577 A1 * 10/2012 Ganyi ..... A61B 5/1117 702/139
2012/0286949 A1 * 11/2012 Worthington ..... F16P 3/14 340/539.1
2012/0314901 A1 * 12/2012 Hanson ..... A61B 5/0077 382/103
2013/0054180 A1 * 2/2013 Barfield ..... G01P 15/0891 702/138
2013/0082842 A1 * 4/2013 Balazs ..... G08B 21/04 340/573.1
2013/0120147 A1 * 5/2013 Narasimhan ..... G01P 15/00 340/573.1
2013/0135097 A1 * 5/2013 Doezema ..... G08B 21/0446 340/539.13
2013/0138395 A1 * 5/2013 Baggen ..... G06F 17/18 702/181
2013/0143519 A1 * 6/2013 Doezema ..... G08B 21/0446 455/404.2
2013/0260673 A1 * 10/2013 Loung ..... H04B 7/14 455/7
2013/0331050 A1 * 12/2013 Freitas ..... H04B 1/06 455/227
2014/0062702 A1 * 3/2014 Rubio Andres ..... G08B 21/043 340/573.1
2014/0155705 A1 * 6/2014 Papadopoulos ..... G06F 19/00 600/301
2014/0276238 A1 * 9/2014 Osorio ..... A61B 5/0205 600/595
2014/0313036 A1 * 10/2014 Sweeney ..... G08B 21/0446 340/573.1
2014/0366041 A1 * 12/2014 Stanley-Marbell ..... G06F 9/4825 719/318
2014/0375461 A1 * 12/2014 Richardson ..... G08B 21/0446 340/573.7
2015/0109442 A1 * 4/2015 Derenne ..... G06F 16/78 348/143
2015/0182160 A1 * 7/2015 Kim ..... A61B 5/0488 600/301
2015/0201867 A1 * 7/2015 Peindl ..... A61B 5/1123 600/595
2015/0206410 A1 * 7/2015 Yi ..... G08B 21/0446 340/573.1
2015/0223705 A1 * 8/2015 Sadhu ..... G08B 21/0446 600/301
2015/0269824 A1 * 9/2015 Zhang ..... G08B 21/0438 340/539.12
2015/0269826 A1 * 9/2015 Zhang ..... G08B 21/0446 340/539.12
2015/0305690 A1 * 10/2015 Tan ..... G08B 21/0446 600/301
2016/0140827 A1 * 5/2016 Derenne ..... G08B 21/043 340/573.7
2016/0183607 A1 * 6/2016 Lopez Yunez ..... A41D 13/018 2/455
2016/0183847 A1 * 6/2016 Pae ..... A61B 5/1117 600/301
2016/0203692 A1 * 7/2016 Ten Kate ..... G08B 21/043 340/573.1
2016/0210838 A1 * 7/2016 Yan ..... G08B 21/043
2016/0275771 A1 * 9/2016 Visweswara ..... A61B 5/6822
2017/0061766 A1 * 3/2017 Gu ..... G08B 29/183
2017/0148297 A1 * 5/2017 Ross ..... G08B 21/043
2017/0162020 A1 * 6/2017 Pham ..... A61B 5/0024
2017/0162024 A1 * 6/2017 Pham ..... A62B 35/0006
2017/0162025 A1 * 6/2017 Pham ..... G08B 21/18

FOREIGN PATENT DOCUMENTS

| | | |
|---|---|---|
| GB | 2507787 | 5/2014 |
| JP | 2013-092923 | 5/2013 |
| TW | 200947359 | 11/2009 |
| TW | M394541 | 12/2010 |

* cited by examiner

ELECTRONIC FALL EVENT COMMUNICATION SYSTEM

CROSS REFERENCE TO RELATED APPLICATIONS

This application is a national stage filing under 35 U.S.C. 371 of PCT/US2016/041830, filed Jul. 12, 2016, which claims the benefit of Provisional Application No. 62/273,049, filed Dec. 30, 2015, the disclosure of which is incorporated by reference in its/their entirety herein.

BACKGROUND

Fall protection is critical for occupational health and safety of workers required to work at heights. Unlike other types of hazards a worker is exposed to such as electrical or mechanical hazards, gravitational potential energy is a universal hazard that affects every organization that requires work done at heights. To combat the dangers associated with working at heights, fall protection equipment manufacturers have developed devices to safely arrest a fall of a worker during a fall event. Although these devices generally perform as intended and safely arrest a worker's fall, there is still potential for harm to come to the worker if the worker is not rescued in a timely manner. This situation is especially relevant when the worker is working alone in a remote location.

For the reasons stated above and for other reasons stated below which will become apparent to those skilled in the art upon reading and understanding the present specification, there is a need in the art for an effective and efficient way to communicate a fall event to a third party.

SUMMARY OF INVENTION

The above-mentioned problems of current systems are addressed by embodiments of the present disclosure and will be understood by reading and studying the following specification. The following summary is made by way of example and not by way of limitation. It is merely provided to aid the reader in understanding some of the aspects of the disclosure.

In one embodiment, a fall event detection and communication system is provided. The fall event detection and communication system includes at least one fall detect node and a personal communication application. The at least one fall detect node is to be implemented as part of a fall protection system. The at least one fall detect node includes at least one detection element and a node transmitter. The at least one detection element is to generate an activation signal upon a condition that indicates a fall event has occurred. The node transmitter is to transmit at least one fall detect signal upon receiving the activation signal from the at least one detection element. The personal communication application is stored in a personal communication device. The personal communication application is to cause the personal communication device to monitor for the fall detect signal from the node transmitter of the at least one fall detect node. The personal communication application is further to cause the personal communication device to determine if a fall event has occurred based at least in part on receiving the at least one fall detect signal from the at least one fall detect node. The personal communication application is further yet to cause the personal communication device to communicate with a remote communication device upon determination that a fall event has occurred.

In another embodiment, a fall detect node is provided. The fall detect node includes an at least one detection element and a transmitter. The at least one detection element is implemented with a fall protection system. The detection element is to detect a fall event. The transmitter is in communication with the at least one detection element. The transmitter is further to send a fall detect signal to a personal communication device upon the detection of a fall event by the at least one detection element.

In yet another embodiment, a method of communicating a fall event to a remote communication device is provided. The method includes generating a fall detect signal with at least one fall detect node that is implemented in a fall protection system when a fall event is detected. The at least one fall detect node is monitored for the fall detect signal with a personal communication device. A fall alarm message is generated with the personal communication device based at least in part on a detected fall detect signal from the at least one fall detect node.

BRIEF DESCRIPTION OF THE DRAWINGS

The present disclosure can be more easily understood and further advantages and uses thereof will be more readily apparent, when considered in view of the detailed description and the following figures in which.

In accordance with common practice, the various described features are not drawn to scale but are drawn to emphasize specific features relevant to the present disclosure. Reference characters denote like elements throughout Figures and text.

DETAILED DESCRIPTION

In the following detailed description, reference is made to the accompanying drawings, which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the spirit and scope of the present disclosure. The following detailed description is, therefore, not to be taken in a limiting sense, and the scope of the present disclosure is defined only by the claims and equivalents thereof.

Figure 1:
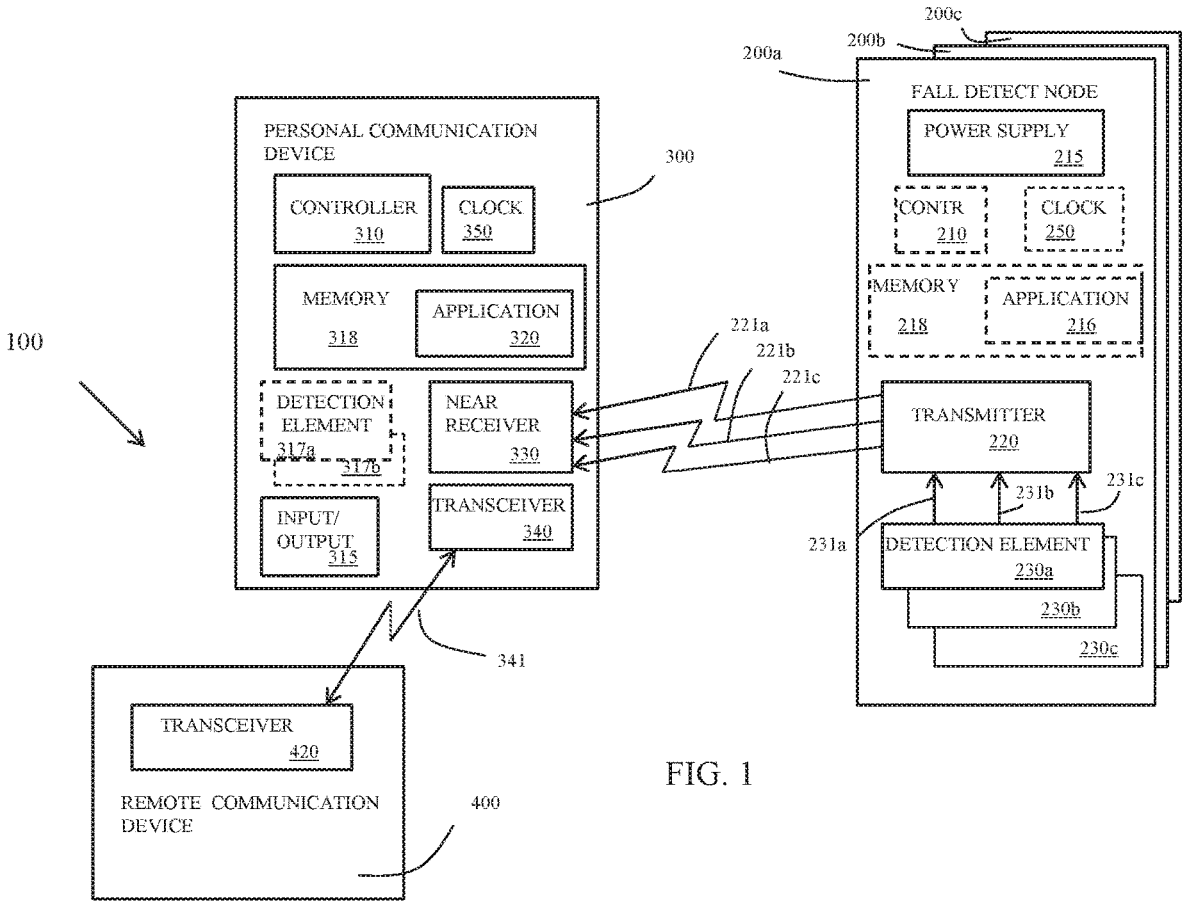
FIG. 1 is a block diagram of a fall event detection and communication system.

Embodiments of the present disclosure provide a fall event detection and communication system. An example of a fall event detection and communication system 100 is illustrated in FIG. 1. The fall event detection and communication system 100 in this embodiment includes at least one fall detect node 200*a*, 200*b* or 200*c*, a personal communication device 300 and a remote communication device 400. Each fall detect node 200*a*, 200*b* and 200*c* in this embodiment includes a least one detection element 230*a*, 230*b* or 230*c*, a transmitter 220 and a power supply 215. The fall detect nodes 200*a*, 200*b* and 200*c* are implemented as part of a fall protection system that is used by a user while working at heights. Examples of the implementation of at least one fall detect node 200*a*, 200*b* or 200*c* are described below.

As discussed above, the fall detect node 200*a*, 200*b* or 200*c*, in the embodiment of FIG. 1 includes at least one detection element 230*a*, 230*b* or 230*c*, a transmitter 220 and a power supply 215. The at least one of the detection elements 230*a*, 230*b* or 230*c* is used to detect a fall event. Each detection element 230*a*, 230*b* and 230*c* is in communication with the transmitter 220. Examples of detection elements 230*a*, 230*b* and 230*c* include, but are not limited to, switches or sensors that detect conditions that indicate a fall event has occurred. For example, in one embodiment, one of the detection elements 230*a*, 230*b* or 230*c* is a pressure switch such as a spring loaded switch that is activated when a select weight is applied. In another embodiment, one of the detection elements 230*a*, 230*b* or 230*c* is an accelerometer sensor. Once at least one of the detection elements 230*a*, 230*b* or 230*c* detects a fall event, a respective activation signal 231*a*, 231*b* and 231*c* is sent to the transmitter 220. Upon receiving the activation signal, the transmitter 220 of the respective fall detect node 200*a*, 200*b* or 200*c*, powered by the power supply 215, transmits a fall detect signal 221*a*, 221*b* or 221*c*. In one embodiment, the fall detect signal 221*a*, 221*b* and 221*c* is a short range communication signal, such as but not limited to, a Bluetooth signal. A Bluetooth signal is a wireless signal using a Bluetooth wireless technology standard for exchanging data over short distances. The Bluetooth standard uses short-wavelength UHF radio waves.

In an alternative embodiment, at least one of the fall detect nodes 200*a*, 200*b* or 200*c* further includes a node memory 218 in which a node application 216 is stored. This embodiment also includes a node controller 210 to implement the node application 216 and a node clock 250. In an embodiment, the node controller 210 using instructions stored in the application 216 controls the transmitter 220 to transmit the fall detect signal 221*a*, 221*b* or 221*c* only after a select period of time has passed, determined with the use of the clock 250, in which one of the detection elements 230*a*, 230*b* or 230*c* has continuously detected a fall event. Although only three fall detection nodes 200*a*, 200*b* and 200*c* and three detection elements 230*a*, 230*b* and 230*c* per each fall detection node 200*a*, 200*b* and 200*c* is illustrated in FIG. 1, any number of fall detection nodes having at least one detection element could be used and the present disclosure is not limited to only three fall detection nodes 200*a*, 200*b* and 200*c* and three detection elements 230*a*, 230*b* and 230*c* per each fall detection node 200*a*, 200*b* and 200*c*.

The personal communication device 300 includes a near receiver 330 to receive the fall detect signal from the transmitter 220 of the fall detect node 200*a*, 200*b* and 200*c*. In one embodiment, the personal communication device 300 is a cellular phone. However, any type of personal communication device that can receive the fall detect signal can be used. For example, with the Bluetooth standard being used as the near communication standard, a cell phone with a receiver that communicates with the Bluetooth standard can be used. The personal communication device 300 in the embodiment of FIG. 1 also includes a personal communication controller 310 such as a processor, a personal communication clock 350, an input/output 315, a personal communication memory 318 and a transceiver 340.

The personal communication controller 310 controls operation of the personal communication device. Instructions implemented by the personal communication controller 310 to operate the personal communication device 300 are stored in the memory 318. Also illustrated in FIG. 1 in the personal communication device 300 is a personal communication application 320 that is also stored in the personal communication memory 318. The personal communication application 320 is a specific set of instructions implemented by the personal communication controller 310 for a specific purpose as described below. The personal communication controller 310 implements the application instructions when the application is activated by the user through the input/output 315 of the device 300. The personal communication clock 350 in this embodiment is used, among other reasons, to count the time the personal communication device 300 is receiving a fall detect signal 221*a*, 221*b* or 221*c* from the fall detect node 200*a*, 200*b* or 200*c*.

The transceiver 340 is used by the personal communication device 300 to send and receive signals over long distances. In the cellular phone example, the transceiver 340 would send and receive signals over a cellular network to a remote communication device 400. The remote communication device 400 could be another cell phone or land line that is located remote to the personal communication device 300. Through the personal communication transceiver 340 of the personal communication device 300, a fall alarm message 341 is sent to a remote transceiver 420 of the remote communication device 400 in embodiments. Moreover, in one embodiment, the personnel communication device 300 includes one or more detection elements 317*a* and 317*b*. Similar to the detection elements 230*a*, 230*b* and 230*c* in the fall detection node 200*a*, 200*b* and 200*c*, detection elements 317*a* and 317*b* can be used to detect fall events. An example of a detection element 317*a* and 317*b* is an accelerometer. However, other types of detection elements can be used in the personal communication device.

Figure 2:
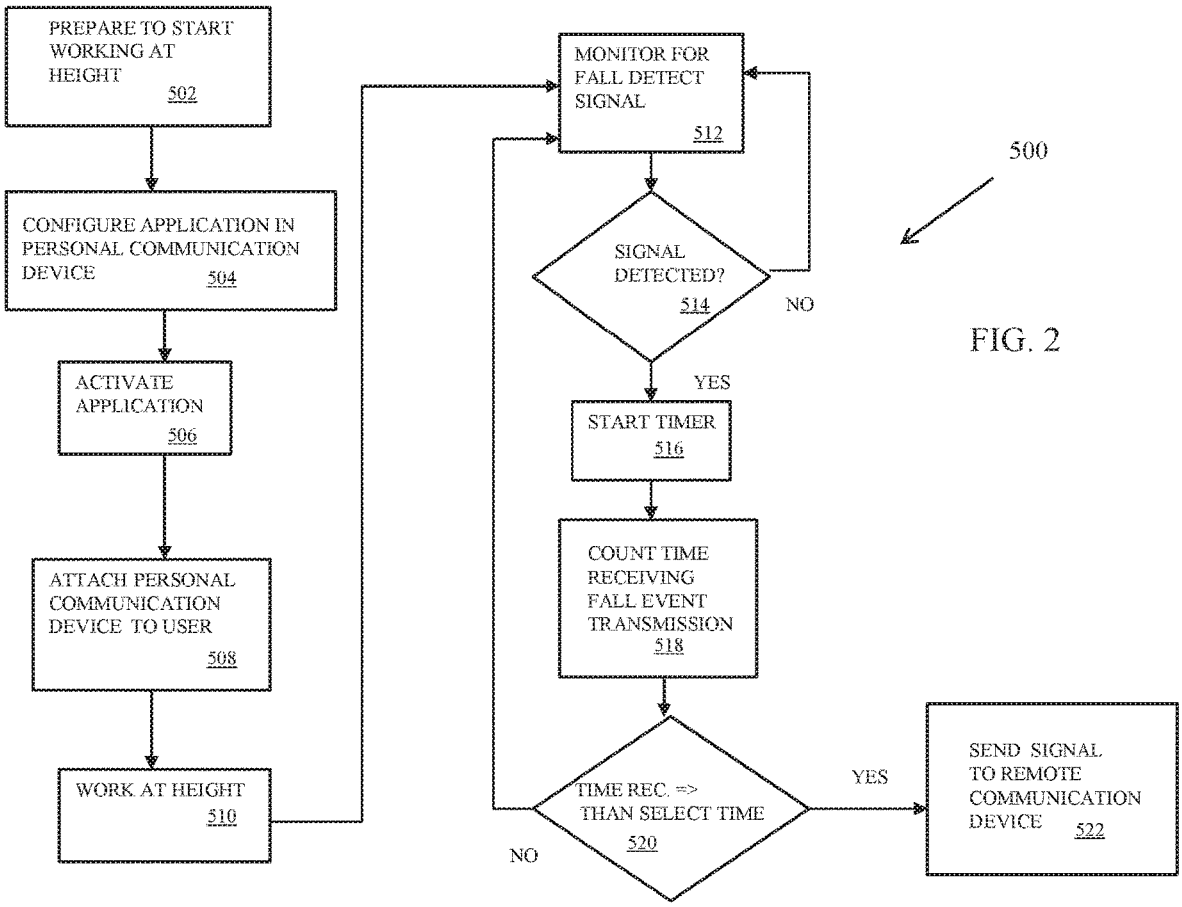
FIG. 2 is an application flow diagram of one embodiment of the present disclosure.

Referring to FIG. 2, an application flow diagram 500 of one embodiment is illustrated. The process starts by the user getting prepared for working at a height (502). In one embodiment, this would include implementing a fall protection system. For example, implementing fall protection system may include donning a safety harness and configuring the application 320 in the personal communication device 300 (504). The configuration may include providing a communication number to call if a fall event is detected, how long a fall detect signal 221*a*, 221*b* or 221*c* needs to be observed from the fall detect node 200*a*, 200*b* or 200*c* before a fall alarm message 341 is sent to the remote communication device 400, the type of fall alarm message 341 to send and content of the fall alarm message 341, etc. Once the application 320 is configured (504), the application 320 is activated on the personal communication device 300 (506). The personal communication device is then attached to the user who is going to be working at heights (508). The user then works at heights (510).

While the user is working at heights, the personal communication device 300 monitors for a fall detect signal 221*a*, 221*b* or 221*c* (512) pursuant to the directions set out by the application 320. If no fall detect signal 221*a*, 221*b* or 221*c* is detected (514), the process continues at (512). If a fall detect signal 221*a*, 221*b* or 221*c* is detected (514), in one embedment, the controller 310 of the personal communication device 300 starts a timer (516) (tracks time using the clock 350) pursuant to the instructions of the application 320. The controller 310 counts the time the near receiver 330 in this embodiment is receiving the fall detect signal 221*a*, 221*b* or 221*c* (518). If the continuous time receiving a fall detect signal 221*a*, 221*b* and 221*c* is less than the time configured in the application (520), the process continues back at (512) monitoring for a fall detect signal 221*a*, 221*b* or 221*c*. If the continuous time receiving fall detect signal 221*a*, 221*c* or 221*c* is equal or greater than the time configured in the application (520), the controller 310 of the personal communication device 300 activates the transceiver 340 to send a fall alarm message 341 to the remote communication device 400 (522).

Based on the received fall alarm message 341, rescue personal will be sent to rescue the fallen user. An example of a period of time configured in the application is a time that is more than 10 seconds and an example of a weight used by a fall detect node 200*a*, 200*b* or 200*c* to send the fall detect signal 221*a*, 221*b* or 221*c* is 130 lbs or more. In another embodiment, as discussed above, at least one of the fall detect nodes 200*a*, 200*b* or 200*c* is equipped to determine the continuous time its respective detection element 230*a*, 230*b* or 230*c* has detected a fall event. In this embodiment, a respective fall detect signal 221*a*, 221*b* or 221*c* will only be sent after the period of time has been confirmed. Further in this embodiment, the controller 310 of the personal communication device, pursuant to the instructions stored in the application 320, sends the fall alarm message 341 as soon as the respective fall detect signal 221*a*, 221*b* or 221*c* is detected.

Figure 3:
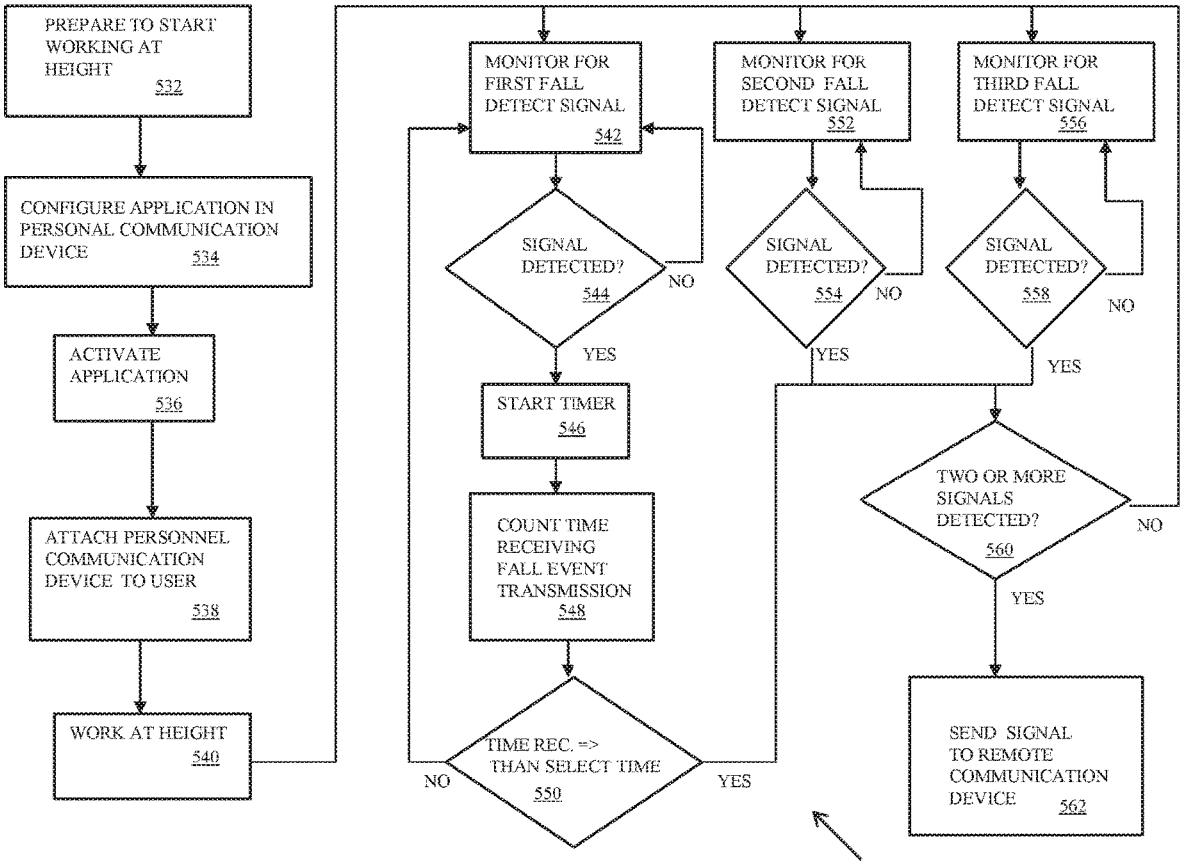
FIG. 3 is an application flow diagram for another embodiment of the present disclosure.

FIG. 3 illustrates an application flow diagram 530 of another embodiment. In this embodiment, at least two different detection elements are used when initiating a fall alarm message 341. For example, the at least two different detection elements may be selected among detection elements 230*a*, 230*b*, 230*c*, 317*a* and 317*b*. The process starts by the user getting prepared for working at a height (532). In one embodiment this would be done by implementing a fall protection system. Implementing the fall protection system may include donning a safety harness and configuring the application 320 in the personal communication device 300 (534). The configuration may include providing a communication number to call if a fall event is detected, the number of different signals from different detection elements 230*a*, 230*b*, 230*c*, 317*a*, 317*b* that are needed for a determination and verification of a fall event, how long a fall detect signal 221*a*, 221*b* and 221*c* needs to be observed from a detection element 230*a*, 230*b*, 230*c*, 317*a* and 317*b* before a fall alarm message 341 is sent to the remote communication device 400, type of fall alarm message 341 to send and content of fall alarm message 341, etc. Once the application 320 is configured (534), the application 320 is activated on the personal communication device 300 (536). The personal communication device is then attached to the user who is going to be working at heights (538). The user then works at heights (540).

While the user is working at heights, the personal communication device 300 monitors for fall detect signals (542), (552) and (556) pursuant to instructions set out by the application 320. The fall detect signals could be fall detect signals 221*a*, 221*b*, 221*c*. Moreover, the fall detect signals may come from detection elements 317*a* and 317*b*. Although the application flow diagram 530 indicates three different types of fall detect signals as used in this example, such as fall detect signals 221*a*, 221*b* and 221*c* from three different detection elements 230*a*, 230*b* and 230*c*, any number of different types of detection elements can be used.

In the application flow diagram 530 of FIG. 3, a personal communication device 300 monitors for a first fall detect signal, such as fall detect signal 221*a* from the first detection element 230*a*. In this embodiment, when a first fall detect signal 221*a* is detected (544), a timer is started (546). The controller 310 counts the time the near receiver 330 in this embodiment is receiving the fall detect signal 221*a* (548). If the continuous time receiving the fall detect signal 221*a* is less than the time configured in the application (550), the process continues back at (542) monitoring for the fall detect signal 221*a*. If the continuous time receiving the fall detect signal 221*a* is equal or greater than the time configured in the application (550), the controller 310 in this embodiment confirms if at least one other fall detect signal has been detected (560). For example, communication device 300 monitors for a second fall detect signal, such as fall detect signal 231*b* from the second detection element 230*b* at (552) and a third fall detect signal, such as fall detect signal 231*c* from the third detection element 230*c* at (556).

As stated above, in this embodiment, if two or more fall detect signals 221*a*, 221*b* and 221*c* are detected (544), (554) and (558), the fall alarm message 341 is sent to the remote communication device 400 (562). Hence, this embodiment allows for the confirmation of a fall event by requiring at least two independent fall detect systems to detect a fall event simultaneously. This cuts down on false fall detection events. For example, one detection element 230*a* may be a sensor that measures a load, while detection element 230*b* is a switch that is activated when a certain amount of force is applied and detection element 230*c* may be an accelerometer. Moreover, as discussed above, the personal communication device may include detection elements 317*a* and 317*b* (such as, but not limited to, accelerometer and/or decelerometer) that can also be used alone or in conjunction with detection elements 230*a*, 230*b* and 230*c* in the fall detect node 200*a*, 200*b* and 200*c* to detect and confirm fall events. Moreover, in another embodiment, at least one fall detect node 200*a*, 200*b* or 200*c* is equipped to count periods of time a fall event is detected by a detection element 230*a*, 230*b*, and 230*c*. In this embodiment, the personal communication controller 310 is configured to recognize that a fall event has been detected as soon as a fall detect signal 221*a*, 221*b* or 221*c* from the respective at least one node 200*a*, 200*b* and 200*c* is detected. The controller 310 in this embodiment would wait for at least one other fall detect signal for verification until a fall alarm message is sent.

Although specific embodiments have been illustrated and described herein, it will be appreciated by those of ordinary skill in the art that any arrangement, which is calculated to achieve the same purpose, may be substituted for the specific embodiments shown. This application is intended to cover any adaptations or variations of the present disclosure. Therefore, it is manifestly intended that this disclosure be limited only by the claims and the equivalents thereof.

The invention claimed is:

1. A system comprising:

a fall protection harness configured with a fall detect node, wherein the fall protection harness is configured to be worn by a worker and arrest a fall of the worker during a fall event, and wherein the fall detect node is configured to transmit a first, fall detect signal in response to the fall of the worker; and a personal communication device comprising one or more computer processors configured to:

configure the fall detect node with the personal communication device via a short-range wireless communication;

in response to receiving the first, fall detect signal via the short-range wireless communication based on the fall of the worker, determine an amount of continuous time that the personal communication device receives at least the first, fall detect signal; and in response to determining that the amount of continuous time that the personal communication device receives at least the first, fall detect signal is greater than or equal to a configured time in the personal communication device, send, via a wireless communication that is different than the short-range wireless communication, a fall alarm message to a remote communication device that is configured to perform at least one operation based at least in part on at least one of a type or content of the fall alarm message.

2. The system of claim 1:

wherein the fall detect node comprises a plurality of detection elements;

wherein the personal communication device is configured to receive, from the plurality of detection elements, a plurality of fall detect signals comprising at least the first, fall detect signal; and wherein the personal communication device is configured to send the fall alarm message to the remote communication device in response to a determination by the personal communication device that at least the plurality of fall detect signals are received from the fall detect node.

3. The system of claim 2:

wherein the personal communication device is configured to send the fall alarm message to the remote communication device in response to a determination by the personal communication device that each of at least the plurality of fall detect signals are received from the fall detect node for the amount of continuous time that is greater than or equal to the configured time in the personal communication device.

4. The system of claim 2:

wherein the personal communication device is configured to send the fall alarm message to the remote communication device in response to a determination by the personal communication device that the plurality of fall detect signals comprising at least the first, fall detect signal are received by the personal communication device at a same time.

5. The system of claim 2:

wherein the personal communication device is configured to send the fall alarm message to the remote communication device in response to a determination by the personal communication device that a second, fall detect signal in the plurality of fall detect signals was received by the personal communication device after waiting for both the first, fall detect signal and the second fall detect signal, wherein the first, fall detect signal was received prior to the second, fall detect signal.

6. The system of claim 2, wherein the plurality of detection elements comprises two or more of an accelerometer, a switch that is activated in response to a certain amount of applied force, or a sensor that measures a load.

7. The system of claim 2, wherein the configured time in the personal communication device is at least 10 seconds.

8. The system of claim 2, wherein the personal communication device is configured to send the fall alarm message to the remote communication device in response to a determination by the personal communication device that the plurality of fall detect signals comprises a second, fall detect signal that is generated based at least in part on a determination by the fall detect node that a weight detected by the fall detect node is greater than a configured weight at the personal communication device.

9. A computing device comprising:

a memory; and one or more computer processors, wherein the memory comprises instructions that, when executed by the one or more computer processors, cause the one or more computer processors to:

configure a fall detect node with the computing device via a short-range wireless communication, wherein a fall protection harness is configured with the fall detect node, wherein the fall protection harness is configured to be worn by a worker and arrest a fall of the worker during a fall event, and wherein the fall detect node is configured to transmit a first, fall detect signal in response to the fall of the worker;

in response to receiving the first, fall detect signal via the short-range wireless communication based on the fall of the worker, determine an amount of continuous time that the computing device receives at least the first, fall detect signal; and in response to determining that the amount of continuous time that the computing device receives at least the first, fall detect signal is greater than or equal to a configured time in the computing device, send, via a wireless communication that is different than the short-range wireless communication, a fall alarm message to a remote communication device that is configured to perform at least one operation based at least in part on at least one of a type or content of the fall alarm message.

10. The computing device of claim 9:

wherein fall detect node comprises a plurality of detection elements;

wherein the memory comprises instructions that when executed cause the one or more computer processors to:

receive, from the plurality of detection elements, a plurality of fall detect signals comprising at least the first, fall detect signal; and send the fall alarm message to the remote communication device in response to a determination by the computing device that at least the plurality of fall detect signals are received from the fall detect node.

11. The computing device of claim 10, wherein the memory comprises instructions that when executed cause the one or more computer processors to:

send the fall alarm message to the remote communication device in response to a determination by the computing device that each of at least the plurality of fall detect signals are received from the fall detect node for the amount of continuous time that is greater than or equal to the configured time in the computing device.

12. The computing device of claim 10:

wherein the computing device is configured to send the fall alarm message to the remote communication device in response to a determination by the computing device that the plurality of fall detect signals comprising at least the first, fall detect signal are received by the computing device at a same time.

13. The computing device of claim 10:

wherein the computing device is configured to send the fall alarm message to the remote communication device in response to a determination by the computing device that a second, fall detect signal in the plurality of fall detect signals was received by the computing device after waiting for both the first, fall detect signal and the second fall detect signal, wherein the first, fall detect signal was received prior to the second, fall detect signal.

14. The computing device of claim 10, wherein the plurality of detection elements comprises two or more of an accelerometer, a switch that is activated in response to a certain amount of applied force, or a sensor that measures a load.

15. The computing device of claim 10, wherein the configured time in the computing device is at least 10 seconds.

16. The computing device of claim 10, wherein the computing device is configured to send the fall alarm message to the remote communication device in response to a determination by the computing device that the plurality of fall detect signals comprises a second, fall detect signal that is generated based at least in part on a determination by the fall detect node that a weight detected by the fall detect node is greater than a configured weight at the computing device.

17. A fall detect node, configured for a fall protection harness worn by a worker to arrest a fall of the worker, wherein the fall detect node comprises:

at least one detection element configured to generate at least a first, fall detect signal in response to the fall of the worker;

a transmitter configured to transmit the fall detect signal in response to the fall of the worker; and a controller configured to:

configure the fall detect node with a computing device via a short-range wireless communication, wherein the fall protection harness is configured with the fall detect node;

in response to receiving the first, fall detect signal from the at least one detection element, transmit, via the transmitter using the short-range wireless communication, the first, fall detect signal to the computing device to cause the computing device to, in response to determining that an amount of continuous time that the computing device receives at least the first, fall detect signal is greater than or equal to a configured time in the computing device, send, via a wireless communication that is different than the short-range wireless communication, a fall alarm message to a remote communication device that is configured to perform at least one operation based at least in part on at least one of a type or content of the fall alarm message.

* * * * *